US007164074B1

(12) United States Patent
Graham

(10) Patent No.: US 7,164,074 B1
(45) Date of Patent: Jan. 16, 2007

(54) QUICK RELEASE MALLET HOLDER AND RIM PROTECTOR

(76) Inventor: Neal Edwin Graham, 8204 Meadow Hills Dr., Fort Wayne, IN (US) 46835

( * ) Notice: Subject to any disclaimer, the term of this patent is extended or adjusted under 35 U.S.C. 154(b) by 0 days.

(21) Appl. No.: 11/188,256

(22) Filed: Jul. 25, 2005

(51) Int. Cl.
*G10D 13/02* (2006.01)

(52) U.S. Cl. ..... 84/421
(58) Field of Classification Search ..... 84/411 R, 84/421
See application file for complete search history.

(56) References Cited

U.S. PATENT DOCUMENTS 633,488 A * 9/1899 Reed ..... 84/421
6,031,169 A * 2/2000 Coppola ..... 84/411 R

* cited by examiner

*Primary Examiner*—Kimberly Lockett

(57) ABSTRACT

An easily removable unit that provides a means of holding the players mallets as well as affording a protective edge for the bass drum rim of a marching bass drum as used in marching bands and drum corps. The device is held in place by a rim claw on the bass drum rim that serves to hold the unit in place while also providing protection of the rim when being struck by the players mallet shaft. The claw slides in a slotted track that also holds a gripper for holding the players mallets. The rim claw is retained in the slot by a tension spring that allows the player to remove the unit by pulling the rim claw away from the rim.

10 Claims, 4 Drawing Sheets

QUICK RELEASE MALLET HOLDER AND RIM PROTECTOR

FIELD OF THE INVENTION

The present invention relates to musical instruments and, more particularly, to marching bass drums as used in marching bands and drum corps for the combined purpose of holding mallets and protecting the edge of the rims from damage when playing.

BACKGROUND OF THE INVENTION

Marching bass drums present specific difficulties and limitations. Players are frequently asked to perform with varying mallet selections. This creates the problem of where to store the additional mallets when not in use. Typically, grippers of plastic or metal are permanently fastened to the drum. This requires permanently disfiguring the surface of the bass drum with adhesives or by using fasteners compromising the integrity of the shell of the drum. Additionally, by being permanently affixed to the drum, storage and transportation becomes a difficulty. The affixed grippers frequently extend too far to fit correctly in the case and are subject to breakage when being stored or transported. Additionally, it is common practice to play directly on the rim with the shank of the mallets for a sound known as rim clicks. This practice can rapidly cause the rim to be chipped away or broken. In order to reduce this destruction of the wooden bass drum rims, a protective edge is desirable to keep the mallet shafts from coming into direct contact with the wooden rims. In order to resolve these limitations it is desirable to be able to quickly remove the apparatus as well as be able to reposition it to the most desirable position for access of the performer when executing rim clicks.

It is therefore an object of the invention to provide a means of holding the mallets used to play the marching bass drum.

It is another object of the invention to afford protection of the edge of the bass drum rim when being struck by the performers mallets.

It is another object of the invention to allow the unit to be quickly removed for transporting and storing the drum.

SUMMARY OF THE INVENTION

In accordance with the present invention, there is provided an easily removable unit that provides a means of holding the players mallets as well as affording a protective edge for the bass drum rim of a marching bass drum as used in marching bands and drum corps. The device is held in place by a rim claw on the bass drum rim that serves to hold the unit in place while also providing protection of the rim. The claw slides in a slotted track that also holds a gripper for holding the players mallets. The rim claw is retained in the slot by a tension spring that allows the player to remove the unit by pulling the rim claw away from the rim.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
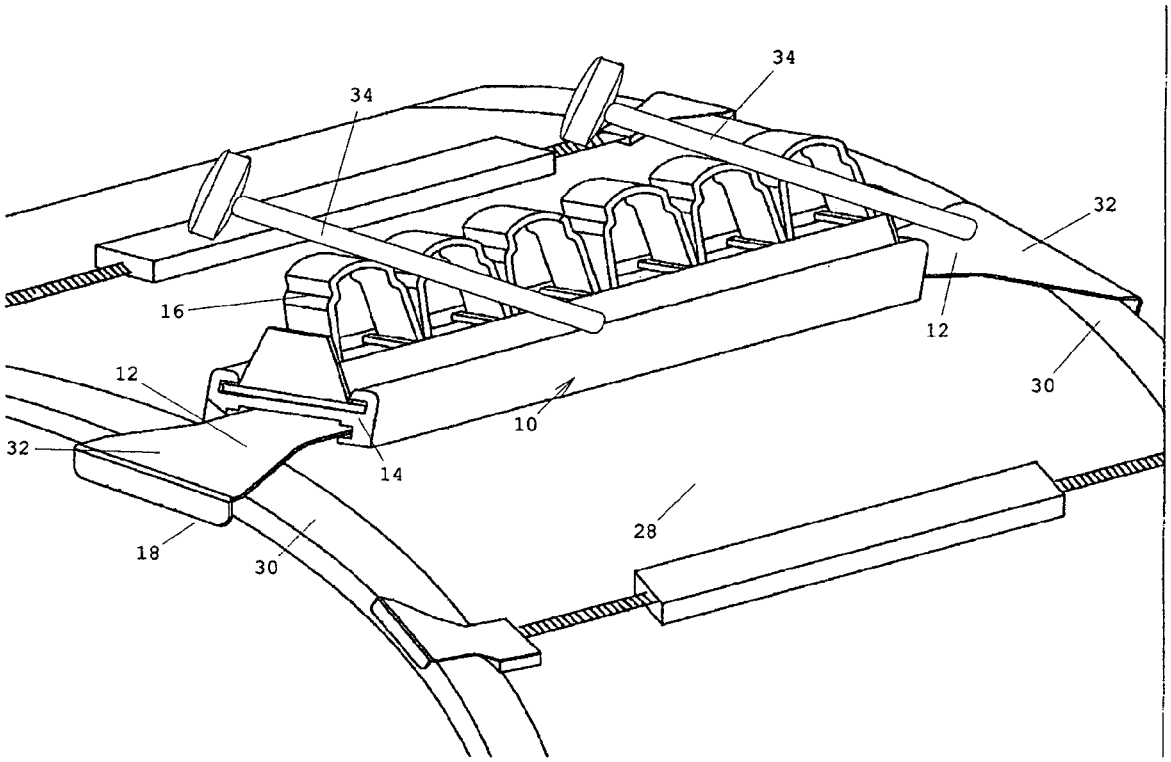
FIG. 1 is a perspective view of a quick release mallet holder/rim protector.

FIG. 1 is a perspective view of a Quick Release Mallet Holder/Rim Protector showing the rim protector and mallet holder 10 as attached to a typical marching bass drum 28. The rim protector and mallet holder 10 is retained on the bass drum rim 30 by the rim claw 12 that is held in place by the slotted track 14. A mallet gripper 16 constructed of plastic or metal is attached to the slotted track 14 for the purpose of holding a bass drum mallet 34 used to play the marching bass drum 28. The rim claw 12 made of metal or composite material such as plastic, fiber glass or similar composite materials also serves to protect the edge of the bass drum rim 30 when struck by the shank of the bass drum mallet 34, a practice known as rim clicks typically executed by players in the marching band and drum corps field.

Figure 2:
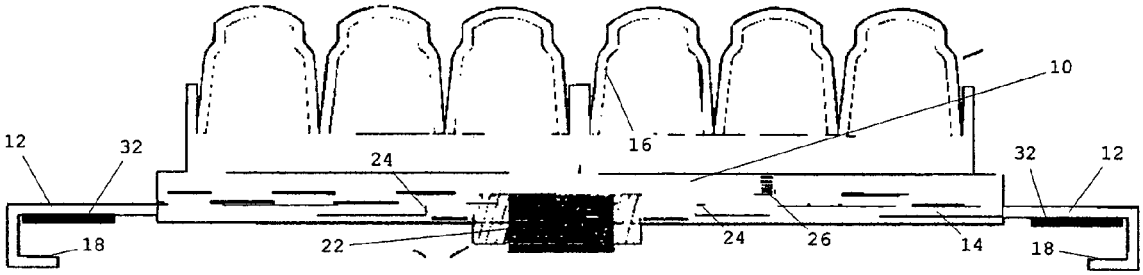
FIG. 2 is a side view view of a quick release mallet holder/rim protector.

FIG. 2 is a side view of a Quick Release Mallet Holder/Rim Protector showing the location of the tension spring 20 used to retain the unit on the bass drum rim 30. The rim claw 12 is held on the bass drum rim 30 by the tension of the tension spring 20. A rubber insulator 22 covers the spring to eliminate vibrations between the tension spring 20 and the bottom side of the slotted track 14. The mallet gripper 16 is fastened into the slotted track 14 and made accessible to the player for quickly inserting and removing the mallets. This quick release feature allows the rim protector and mallet holder 10 to be easily detached from the marching bass drum 28 for simple repositioning as well as for ease of storage. The rim claw 12 is designed with a retaining tab 18 that wraps over the bass drum rim 30 to retain the rim claw 12 edge on the bass drum rim 30 for providing an edge to be struck by the mallet as well as retaining the unit in position on the marching bass drum 28. A pad 32 is installed on the rim claw 12 to seperate the rim claw 12 from the bass drum rim 30.

Figure 3:
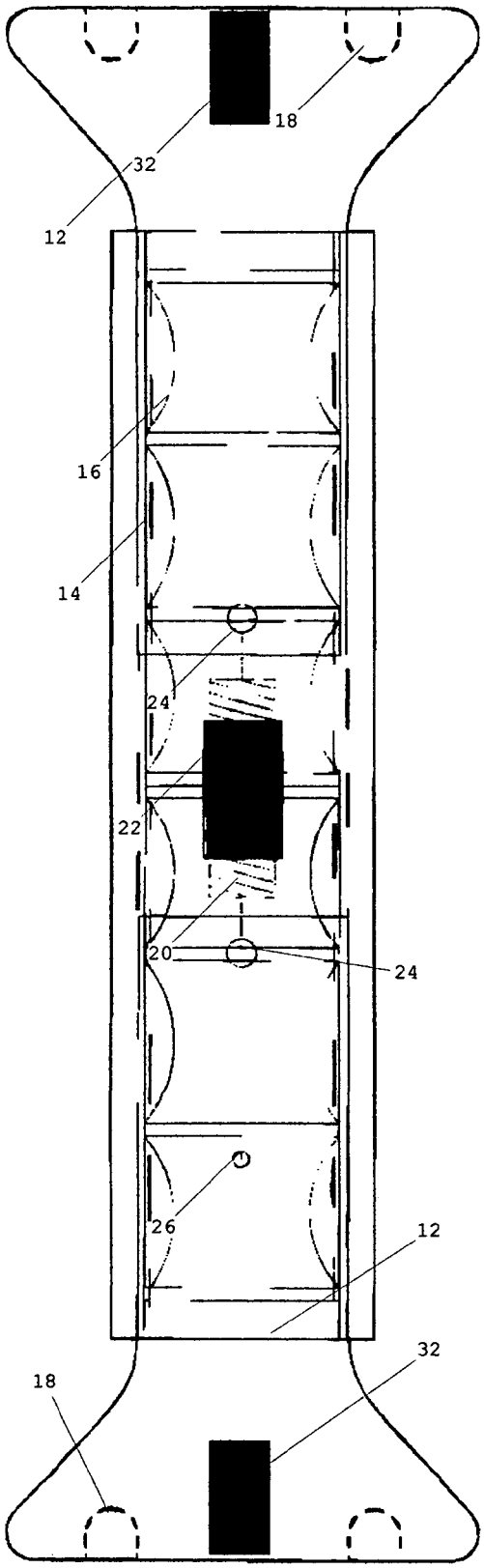
FIG. 3 is a bottom view of a bottom assembled view.

FIG. 3 is a bottom assembled view showing the tension spring 20 as attached to the spring attachment holes 24. The spring is covered by the rubber insulator 22 to avoid vibration from the spring coming in contact with the rim claw 12 and the slotted track 14 when the rim claw 12 is positioned in the slotted track 14. There is provided a locking screw 26 that presses against the inside of the slotted track 14 to keep the slotted track 14 from moving side to side when the rim protector and mallet holder 10 is locked into position. This locking screw 26 allows the slotted track 14 to be centered on the marching bass drum 28 between the bass drum rim 30 when locked in place and eliminates the slotted track 14 from moving from side to side.

Figure 4:
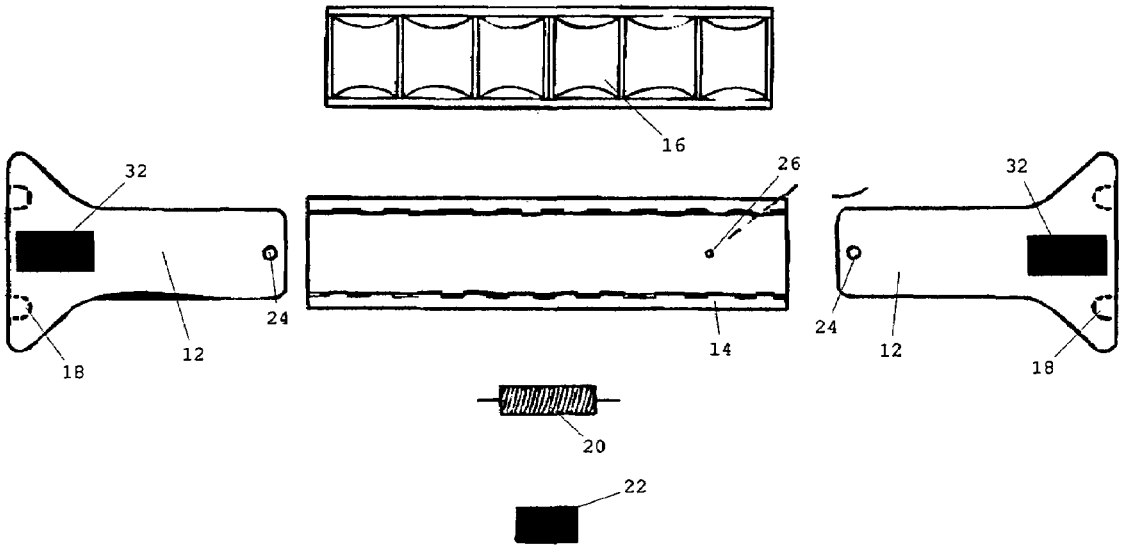
FIG. 4 is an exploded view view of a quick release mallet holder/rim protector.

FIG. 4 is an exploded view of a Quick Release Mallet Holder/Rim Protector showing the components of the rim protector and mallet holder 10. The rim claw 12 has a retaining tab 18 that laps over the edge of the bass drum rim 30 to hold the rim protector and mallet holder 10 in place on the bass drum rim 30. The rim claw 12 inserts into the slot of the slotted track 14 allowing the rim claw 12 to move in and out to attach to the bass drum rim 30 which is seperated from contact by the pad 32. The rim claw 12 is held in position by the tension spring 20 that is surrounded by the rubber insulator 22 to avoid vibrations against the slotted track 14. The locking screw 26 is used to position the rim claw 12 in position in the slotted track 14 to center the slotted track 14 between the bass drum rim 30. The mallet gripper 16 is attached in the slots on the top side of the slotted track 14 to allow access by the player to insert the mallets into the mallet gripper 16.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A quick release mallet holder and rim protector for a quick release, removable mallet holder with rim protector for marching bass drums as used in marching bands and drum corps, comprising:

means for gripping the mallet handle;

means for clamping the device onto the rim;

means for retaining and connecting the rim claws and the mallet holder, slidably inserted to said means for clamping the device onto the rim, and longitudinally connected to said means for gripping the mallet handle;

means for to retain the unit on the drum tuning hoop, angularly constructed to said means for clamping the device onto the rim;

means for tensioning and retention of the rim claws, torsionally connected to said means for clamping the device onto the rim;

means for insulating the spring from contacting the rim claw, concentrically encircling to said means for tensioning and retention of the rim claws;

means for attaching the tension spring to the rim claw, insertably connected to said means for tensioning and retention of the rim claws;

means for locking the adjustment of the rim claw in the slotted track, adjustably fastened to said means for retaining and connecting the rim claws and the mallet holder, and adjustably retained to said means for clamping the device onto the rim; and means for protecting the rim from wear against the rim claw, adhesively attached to said means for clamping the device onto the rim.

2. The quick release mallet holder and rim protector in accordance with claim 1, wherein said means for gripping the mallet handle comprises a plastic or metal, expanding, movable mallet gripper.

3. The quick release mallet holder and rim protector in accordance with claim 1, wherein said means for clamping the device onto the rim comprises a metal, shaped to the rim rim claw.

4. The quick release mallet holder and rim protector in accordance with claim 1, wherein said means for retaining and connecting the rim claws and the mallet holder comprises a track, plastic or metal slotted track.

5. The quick release mallet holder and rim protector in accordance with claim 1, wherein said means for to retain the unit on the drum tuning hoop comprises a retaining tab.

6. The quick release mallet holder and rim protector in accordance with claim 1, wherein said means for tensioning and retention of the rim claws comprises a spring, metal tension spring.

7. The quick release mallet holder and rim protector in accordance with claim 1, wherein said means for insulating the spring from contacting the rim claw comprises a rubber or plastic tubing rubber insulator.

8. The quick release mallet holder and rim protector in accordance with claim 1, wherein said means for attaching the tension spring to the rim claw comprises a spring attachment holes.

9. The quick release mallet holder and rim protector in accordance with claim 1, wherein said means for locking the adjustment of the rim claw in the slotted track comprises a threaded locking screw.

10. The quick release mallet holder and rim protector in accordance with claim 1, wherein said means for protecting the rim from wear against the rim claw comprises a rubber or plastic pad.

* * * * *